US011421927B2

(12) United States Patent
Mitchell

(10) Patent No.: US 11,421,927 B2
(45) Date of Patent: Aug. 23, 2022

(54) REFRIGERATOR APPLIANCE ICE MAKING AND DISPENSING SYSTEM

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 196 days.

(21) Appl. No.: 16/843,158

(22) Filed: Apr. 8, 2020

(65) Prior Publication Data

US 2021/0318050 A1 Oct. 14, 2021

(51) Int. Cl.

| | |
|---|---|
| ***F25C 1/24*** | (2018.01) |
| ***F25C 5/20*** | (2018.01) |
| ***F25C 1/04*** | (2018.01) |
| ***F25C 5/08*** | (2006.01) |
| ***F25C 5/182*** | (2018.01) |
| ***F25D 17/06*** | (2006.01) |
| ***F25D 29/00*** | (2006.01) |
| ***F25D 21/14*** | (2006.01) |

(52) U.S. Cl.

CPC ..... *F25C 1/24* (2013.01); *F25C 1/04* (2013.01); *F25C 5/08* (2013.01); *F25C 5/182* (2013.01); *F25C 5/22* (2018.01); *F25D 17/065* (2013.01); *F25D 21/14* (2013.01); *F25D 29/00* (2013.01); *F25C 2400/10* (2013.01); *F25C 2600/04* (2013.01); *F25C 2700/02* (2013.01); *F25D 2317/061* (2013.01); *F25D 2321/1441* (2013.01)

(58) Field of Classification Search

CPC ..... F25C 1/24; F25C 5/22; F25C 1/04; F25C 5/08; F25C 2305/024; F25C 2700/06; F25D 17/065

See application file for complete search history.

(56) References Cited

U.S. PATENT DOCUMENTS

| | | | | |
|---|---|---|---|---|
| 8,074,464 | B2 | 12/2011 | Davis | |
| 9,482,458 | B2 | 11/2016 | Jeong et al. | |
| 9,733,004 | B2 | 8/2017 | Mitchell et al. | |
| 2006/0174647 | A1* | 8/2006 | Kuehl | F25C 5/182 62/344 |
| 2007/0113578 | A1* | 5/2007 | Wu | F25C 5/182 62/344 |
| 2008/0034779 | A1* | 2/2008 | Lee | F25C 1/04 62/344 |
| 2009/0293508 | A1 | 12/2009 | Hamel | |
| 2010/0326093 | A1* | 12/2010 | Watson | F25B 7/00 62/118 |
| 2011/0162392 | A1* | 7/2011 | Lim | F25D 29/00 62/66 |
| 2018/0266745 | A1 | 9/2018 | Bertolini et al. | |

* cited by examiner

*Primary Examiner* — Elizabeth J Martin

(74) *Attorney, Agent, or Firm* — Dority & Manning, P.A.

(57) ABSTRACT

A refrigerator appliance is provided. The refrigerator appliance includes a fresh food compartment, an ice storage compartment within the fresh food compartment and insulated from the fresh food compartment, a sealed system configured to circulate a refrigerant through a refrigerant conduit; an ice maker positioned in the fresh food compartment and being in direct thermal communication with the sealed system, and an insulated door configured to open and close the ice storage compartment to selectively allow ice from the icemaker to enter the ice storage compartment. Methods of using the refrigerator appliance are also provided.

19 Claims, 8 Drawing Sheets

REFRIGERATOR APPLIANCE ICE MAKING AND DISPENSING SYSTEM

FIELD OF THE INVENTION

The present subject matter relates generally to refrigerator appliances, and more particularly to refrigerator appliances having ice makers and ice storage bins.

BACKGROUND OF THE INVENTION

Refrigerator appliances generally include a cabinet that defines one or more chilled chambers for receipt of food articles for storage. In addition, refrigerator appliances also generally include a door rotatably hinged to the cabinet to permit selective access to food items stored in chilled chamber(s). Certain refrigerator appliances include an icemaker. In order to produce ice, liquid water is directed to the icemaker and frozen. After being frozen, ice may be directed to a separate ice storage bin. In order to maintain ice in a frozen state, the icemaker and the ice storage bin may be positioned within a chilled chambers maintained at a temperature below the freezing point of water, e.g., such as in the freezer chamber or in a separate compartment behind one of the doors.

Conventional icemakers are positioned within a freezer chamber that has a temperature below the freezing point of water, e.g., such that cool air within the freezer chamber can freeze water dispensed into a plurality of ice molds and facilitate the ice making process. However, a common problem with such icemakers is ice buildup. For example, since the icemaker is much colder than the ice, moisture commonly sublimates from the ice and transfers to the icemaker mold. This develops ice buildup or frost on the icemaker. Ice buildup may require costly heating systems required to remove the ice buildup and may result in dispensing failures. Further, conventional icemakers require a water fill tube heater in order to prevent water within the water fill tube from freezing and clogging, potentially damaging the water fill tube or water supply system.

Accordingly, it would be advantageous to provide a refrigerator appliance with an improved ice making assembly that reduces frost buildup and includes feature(s) addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator may include a fresh food compartment. An ice storage bucket may be positioned within the fresh food compartment and may be insulated from the fresh food compartment. A sealed system including a condenser, an expansion device, and an evaporator may be fluidly coupled through a refrigerant conduit, and a compressor may be operably coupled to the refrigerant conduit for circulating a flow of refrigerant through the refrigerant conduit. An icemaker may be positioned within the fresh food compartment above the ice storage bucket and may include an ice mold for receiving water to freeze into ice cubes. The sealed system may be in direct thermal communication with the ice mold. An insulated door may be positioned over an opening in the ice storage compartment, and the insulated door may be movable between an opened and closed position to permit ice to pass into the ice storage compartment.

In another exemplary aspect of the present disclosure, a refrigerator appliance is provided. The refrigerator may include a fresh food compartment and a freezing compartment adjacent to the fresh food compartment. A first sealed refrigerant system may include a compressor, a condenser, an evaporator, an expansion device, and a first liquid-to-liquid heat exchanger on a first refrigerant line and may circulate a first refrigerant through the first refrigerant line. A second sealed refrigerant system may include a second liquid-to-liquid heat exchanger and a pump on a second refrigerant line and heat may be transferred between the first and second liquid-to-liquid heat exchangers to directly cool the ice maker. An icemaker may be positioned within the fresh food compartment and may include an ice mold for receiving water to freeze into ice cubes. The second refrigerant line may pass through the icemaker. An ice storage compartment may be positioned below the icemaker and may be insulated from the fresh food compartment. An insulated door may be positioned over an opening in the ice storage compartment and may be movable between an open and a closed position to permit ice to pass from the icemaker into the ice storage compartment. A controller may control the icemaker, the first sealed refrigerant system, the second sealed refrigerant system, and the insulated door.

In still another exemplary aspect of the present disclosure, a method of operating a refrigerator appliance is provided. The method may include operating a sealed system to cool an icemaker and form ice, determining that ice is ready to be harvested from the icemaker, opening an insulated door of an ice storage compartment, and ejecting the ice from the icemaker such that the ice passes from the icemaker to the ice storage compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
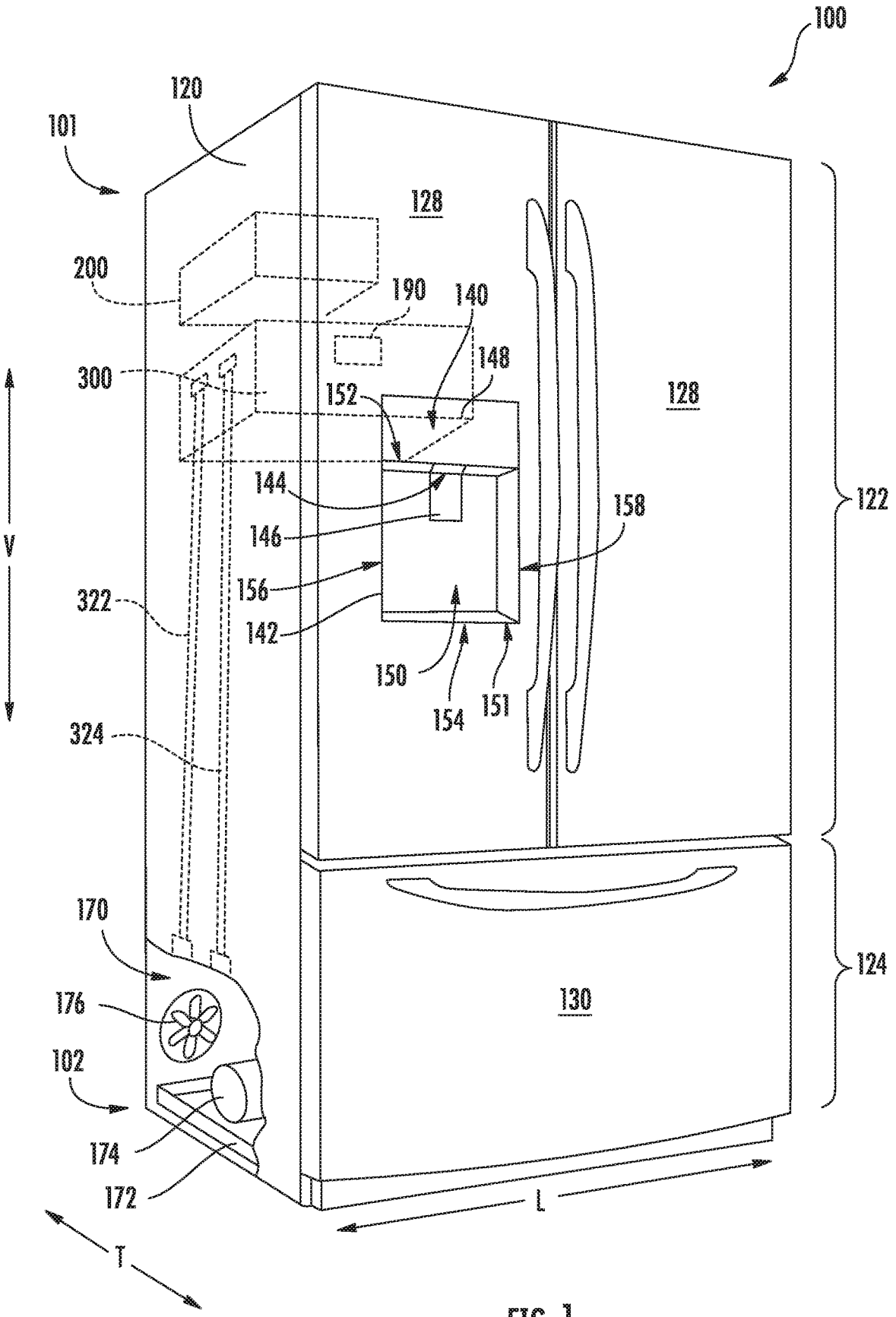
FIG. 1 provides a perspective view of a refrigerator appliance according to an exemplary embodiment of the present disclosure, wherein refrigerator doors are shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the drawings, FIG. 1 provides a pair of refrigerator doors 128 in a closed position. Refrigerator appliance 100 includes a cabinet or housing 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. Cabinet 120 defines one or more chilled chambers for receipt of food items for storage. In some embodiments, cabinet 120 defines a fresh food chamber or compartment 122 positioned at or adjacent top 101 of cabinet 120 and a freezer chamber or compartment 124 arranged at or adjacent bottom 102 of cabinet 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of cabinet 120 for selectively accessing fresh food chamber 122. In some embodiments, a freezer door 130 is arranged below refrigerator doors 128 for selectively accessing freezer compartment 124. Freezer door 130 may be coupled to a freezer drawer (not shown) slidably mounted within freezer compartment 124. Refrigerator doors 128 and freezer door 130 are shown in the closed configuration in FIG. 1.

In some embodiments, refrigerator appliance 100 includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, another suitable actuator may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, as will be described in greater detail below. Generally, dispenser recess 150 defines a transverse opening 151 that extends in the vertical direction V from a top recess end 152 to a bottom recess end 154, as well as in the lateral direction L from a first recess side 156 to a second recess side 158. In certain embodiments, dispenser recess 150 is positioned at a predetermined elevation convenient for a user to access ice or water and enabling the user to access ice without the need to bend-over and without the need to open doors 128. In optional embodiments, dispenser recess 150 is positioned at a level that approximates the chest level of a user.

Generally, operation of the refrigerator appliance 100 can be regulated by a controller 190 that is operatively coupled to user interface panel 148 or various other components, as will be described below. User interface panel 148 provides selections for user manipulation of the operation of refrigerator appliance 100, such as selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located adjacent to or on user interface panel 148. In other embodiments, controller 190 may be positioned at another suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in operable communication (e.g., electrical communication) with controller 190 via one or more signal lines or shared communication busses.

Controller 190 may be operatively coupled with the various components of dispensing assembly 140 and may control operation of the various components. For example, the various valves, switches, etc. may be actuatable based on commands from controller 190. As discussed, interface panel 148 may additionally be operatively coupled (e.g., via electrical or wireless communication) with controller 190. Thus, the various operations may occur based on user input or automatically through controller 190 instruction.

Figure 2:
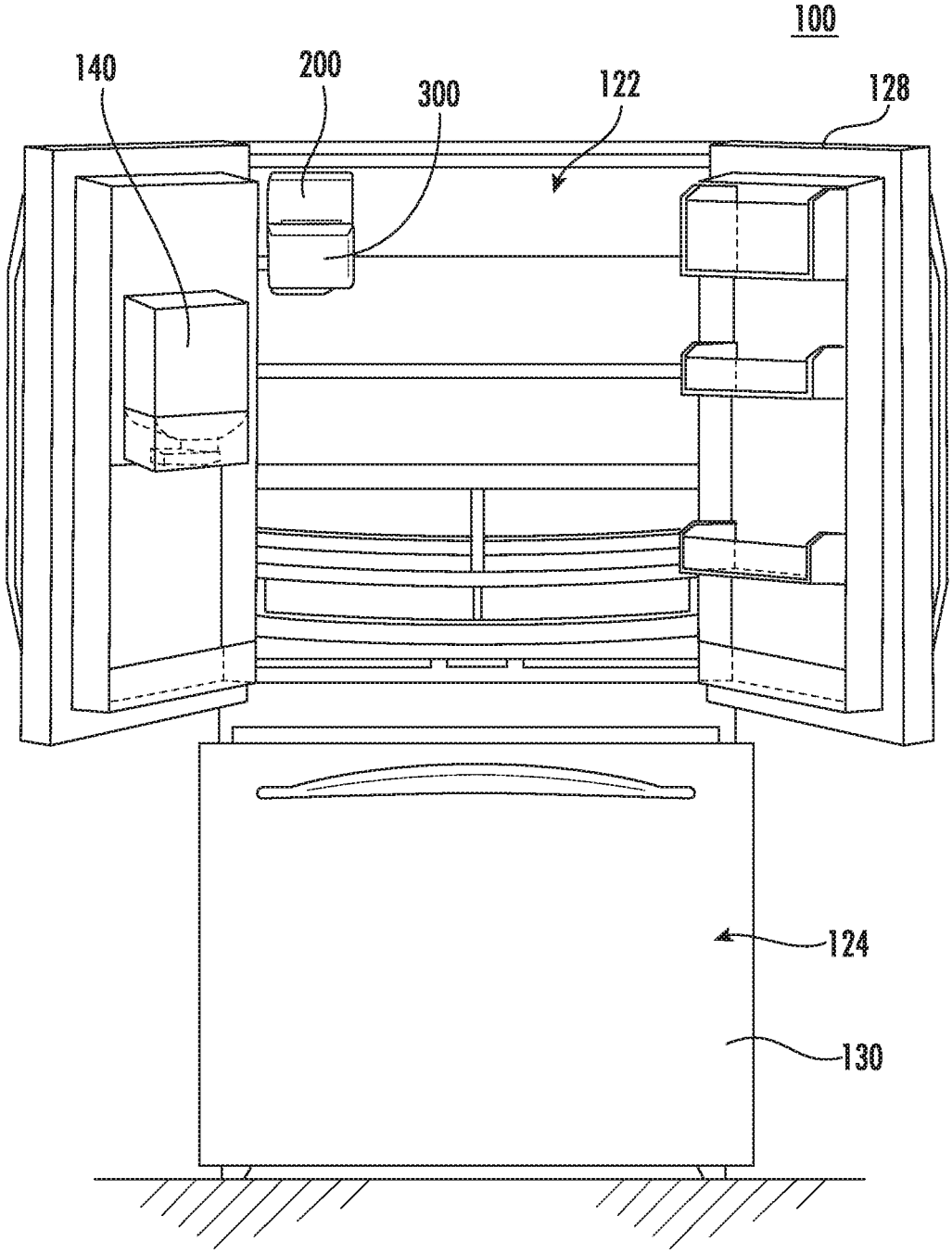
FIG. 2 provides a front view of the exemplary refrigerator appliance of FIG. 1, where in refrigerator doors are shown in an open position.
Figure 3:
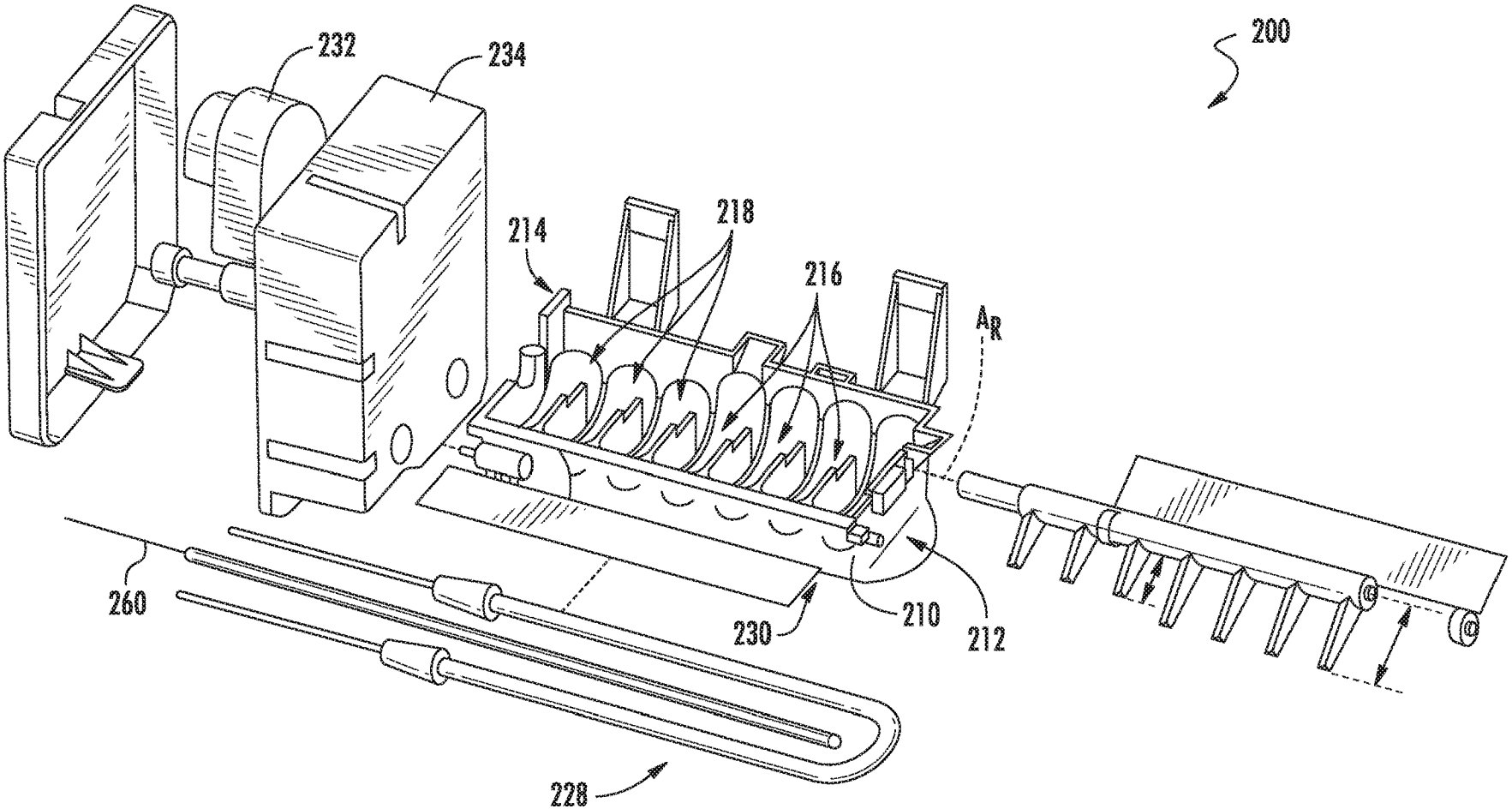
FIG. 3 provides an exploded perspective view of an icemaker of the exemplary refrigerator appliance of FIG. 1.

FIG. 2 is a perspective view of refrigerator appliance 100 having refrigerator doors 128 in an open position to reveal the interior of the fresh food chamber 122 and FIG. 3 provides an exploded perspective view of an exemplary ice maker 200 of the refrigerator appliance 100. As illustrated, refrigerator appliance 100 may include an ice making assembly or icemaker 200, and an ice storage compartment 300. Icemaker 200 may be provided within the fresh food chamber 122 and may be ambiently exposed within the fresh food chamber. In other words, icemaker 200 is not insulated from ambient air within the fresh food chamber 122. More specifically, individual parts of icemaker 200 (which will be described below with reference to FIG. 3), such as a mold body 210, may be exposed within the fresh food compartment 122. Icemaker 200 may be in any suitable location within fresh food compartment 122 such that ice may be formed and moved into ice storage compartment 300. In one example, icemaker 200 is located in an upper left corner of fresh food compartment 122 when viewed from a front of refrigerator appliance 100. As is understood, icemaker 200 may be used within any suitable refrigerator appliance, such as refrigerator appliance 100.

Generally, icemaker 200 includes an ice mold or mold body 210 that extends between a first end portion 212 and a second end portion 214 (e.g., along a rotation axis $A_R$). Mold body 210 defines multiple compartments (e.g., one or more first compartments 216 and one or more second compartments 218) separated by one or more partitions walls for receipt of liquid water for freezing. The compartments 216, 218 may be spaced apart from one another or distributed (e.g., along the rotation axis $A_R$ between first end portion 212 and second end portion 214). Thus, a partition wall may be axially positioned between a first compartment 216 and a second compartment 218.

Generally, icemaker 200 can receive liquid water (e.g., from a water connection to plumbing within a residence or business housing refrigerator appliance 100) and direct such liquid water into mold body 210 (e.g., into compartments 216, 218 of mold body 210). Within compartments 216, 218 of mold body 210, liquid can freeze to form ice cubes. It is understood that the term "ice cube," as used herein, does not require a cubic geometry (i.e., six bounded square faces), but indicates a discrete unit of solid frozen ice generally having a predetermined three-dimensional shape.

As shown, a refrigerant line or refrigerant conduit 228 may run through icemaker 200. For example, refrigerant line 228 is part of a sealed system or sealed refrigerant system to be described below. Accordingly, refrigerant cooled to a temperature below freezing may be cycled through icemaker 200 to produce the ice cubes (e.g., as illustrated schematically in FIGS. 4 through 7). Icemaker 200 may further include a heating element or heater 260 mounted to a lower portion 230 of mold body 210. The heater 260 can be press-fit, stacked, or clamped into the lower portion 230 of the mold body 210. The heater 260 may heat the icemaker 200 after a harvest cycle is performed. Alternatively, the heater 260 may heat the icemaker 200 when frost is detected on the icemaker 200. In some embodiments, the heater 260 may heat the icemaker 200 during periods of non-use (e.g., when the ice storage compartment 300 is full). In some embodiments, the heater 160 may heat the icemaker 200 to assist in releasing ice cubes from the compartments 216, 218 of the mold body 210.

Figure 4:
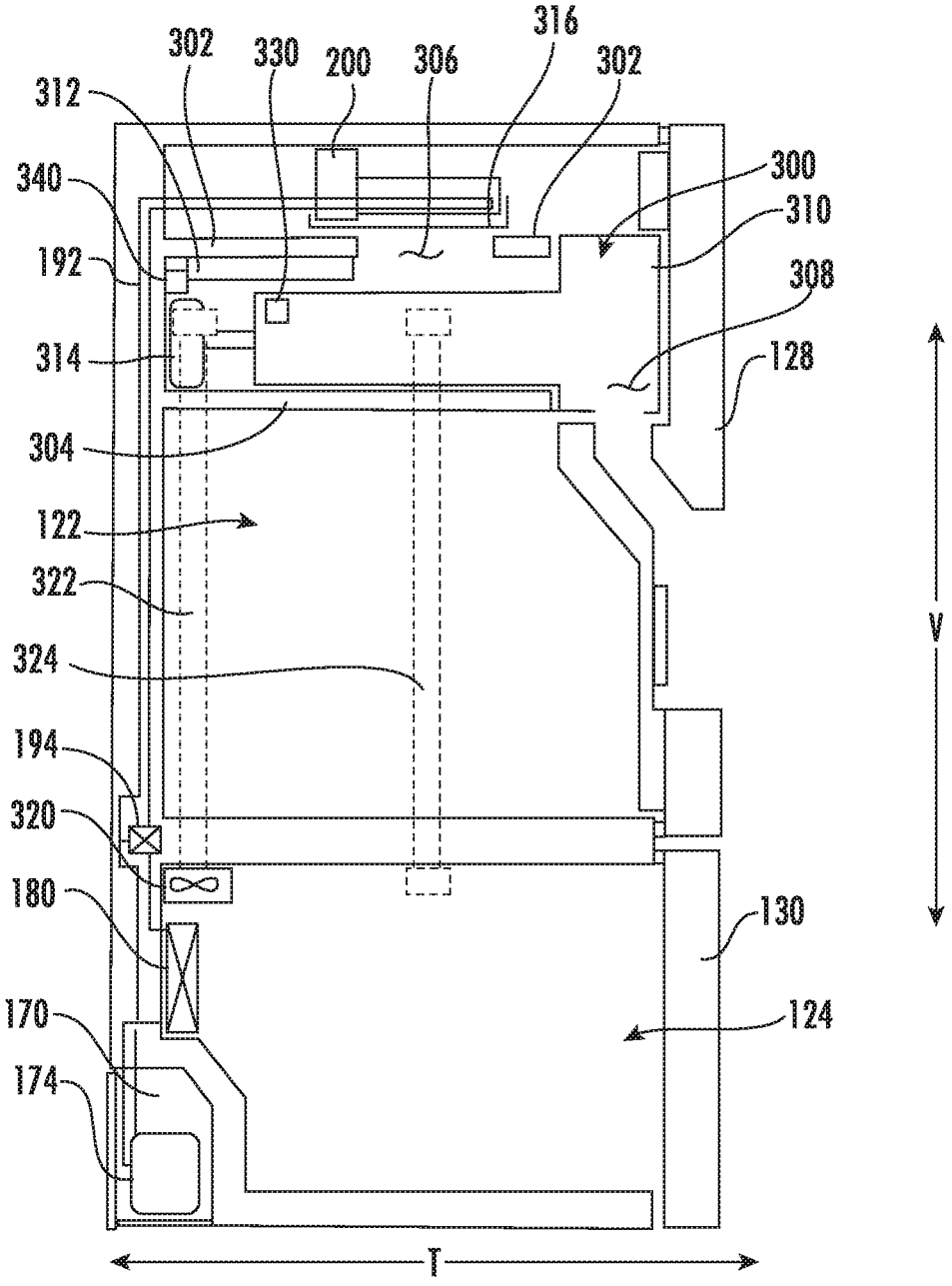
FIG. 4 provides a side cross-sectional view of the exemplary refrigerator appliance of FIG. 1.

FIG. 4 is a cut away side view of an exemplary refrigerator appliance 100. As seen in FIG. 4, icemaker 200 and ice storage compartment 300 may be provided at or near a top of fresh food compartment 122 in the vertical direction V. Specifically, icemaker 200 may be provided above ice storage compartment 300. As such, ice formed in icemaker 200 may be dropped downward in the vertical direction V into ice storage compartment 300. In some embodiments, the ice storage compartment 300 is provided proximal to the icemaker 200 in either or both of the transverse direction T and the lateral direction L. The disclosure is not limited, however, and the ice storage compartment 300 and the icemaker 200 may be located in any suitable positions.

The ice storage compartment 300 may include a top or upper wall 302. The upper wall 302 may be below the icemaker 200. A supply opening 306 may be defined in the upper wall 302. In some embodiments, the supply opening 306 is located beneath the icemaker 200. As such, ice formed in the icemaker 200 may be dropped by gravity into the ice storage compartment 300. According to alternative exemplary embodiments, icemaker 200 may be positioned at other suitable locations relative to the supply opening 306 and may include additional features for dispensing ice through the supply opening, e.g., such as an auger mechanism, an ice chute, or another suitable ice transfer or conveying mechanism.

The ice storage compartment 300 may include a bottom or lower wall 304, provided beneath the upper wall 302. Lower wall 304 may define a lower boundary of the ice storage compartment 300. A dispenser opening 308 may be formed in the lower wall 304 of the ice storage compartment 300. Ice cubes that are stored in the ice storage compartment 300 may be selectively released to dispenser 142 through the dispenser opening 308 according to a user input. A rear of the ice storage compartment 300 may be defined by a rear or side wall of the fresh food compartment 122. A front of the ice storage compartment 300 may be defined by one of the refrigerator doors 128. Alternatively, a separate front wall may be provided and attached to each of the upper wall 302 and the lower wall 304.

The ice storage compartment 300 may include an insulated door 312. The insulated door 312 may selectively open and close the supply opening 306 in the upper wall 302. In some embodiments, the insulated door 312 is attached to the ice storage compartment 300 in a sliding manner. In other words, the insulated door 312 slides in the transverse direction T to selectively open and close the supply opening 306. Alternatively, the insulated door 312 may slide in the lateral direction L to selectively open and close the supply opening 306. In alternate embodiments, the insulated door 312 may be rotatably attached to the ice storage compartment to selectively open and close the supply opening 306. For example, the insulated door 312 may be attached to the ice storage compartment 300 via a rotatable hinge. According to still other exemplary embodiments, insulated door 312 may include one or more resilient flaps that deflect as ice is dispensed and then spring back to insulate the ice storage compartment 300 from the fresh food compartment 122. Other suitable means for insulating ice storage compartment 300 while also selectively permitting ice to enter ice storage compartment 300 are possible and within the scope of the present subject matter.

The insulated door 312 may be configured to slide along an interior of the ice storage compartment 300. In other words, the insulated door 312 may be slidably attached to an under surface of the upper wall 302. Accordingly, when a harvest cycle is executed (e.g., when ice cubes are moved from the icemaker 200 into the ice storage compartment 300), the insulated door 312 may be slid in the transverse direction T along an interior of the ice storage compartment 300. In some embodiments, the insulated door 312 may be slid in the lateral direction L when a harvest cycle is executed. In still other embodiments, the insulated door may be slidably provided on a top surface of upper wall 302. In other words, when a harvest cycle is executed, the insulated door 312 may be slid in the transverse direction T along a top surface of upper wall 302 to open the supply opening 306.

The refrigerator appliance 100 may include a drive mechanism 340 configured to selectively move the insulated door 312 between an opened position and a closed position. The drive mechanism 340 may include a motor. The motor may be any suitable motor. In one example, the motor is a servo motor. The drive mechanism 340 may further include a transmission. The transmission may convert power generated by the motor into linear movement of the door. In one example, the transmission is a slide and roller combination.

An ice storage bucket 310 may be provided in the ice storage compartment 300. The ice storage bucket 310 may be a separate bucket or container configured to hold the ice cubes that are formed in the icemaker 200 and dropped into ice storage compartment 300. The ice storage bucket 310 may be a conventional ice storage bucket. For example, the ice storage bucket includes a dispenser motor 314. The dispenser motor 314 may drive an auger configured to selectively release ice cubes from the ice storage bucket 310 to the dispenser 142.

Refrigerator appliance 100 may include a cooling system for maintaining a suitable temperature within ice storage compartment. For example, according to an exemplary embodiment of the refrigerator appliance 100, the freezer compartment 124 may be provided below the fresh food compartment 122. In order to supply chilled air to the ice storage compartment 300, the refrigerator appliance 100 according to the exemplary embodiment may include a fan 320 for circulating chilled air from the freezer compartment 124 to the ice storage compartment 300. In one example, the fan 320 is a centrifugal fan. However, the fan 320 may be any suitable fan capable of circulating air. The refrigerator appliance 100 may include an air supply duct 322. The air supply duct 322 may fluidly connect the freezer compartment 124 with the ice storage compartment 300. For example, the air supply duct 322 passes through a side wall of the cabinet 120. In alternative embodiments, the air supply duct 322 passes through an interior of fresh food compartment 122. The fan 320 may be located at an inlet of the air supply duct 322 in the freezer compartment 124. An outlet of the air supply duct 322 may be provided at a top of the air supply duct 322. The outlet of the air supply duct 322 may be in fluid communication with the ice storage compartment 300. Chilled air from the freezer compartment 124 may be exhausted into the ice storage compartment 300 via the outlet of the air supply duct 322.

The refrigerator appliance 100 according to an exemplary embodiment may further include an air return duct 324. The air return duct 324 may fluidly connect the freezer compartment 124 with the ice storage compartment 300. For example, the air return duct 324 passes through a side wall of the cabinet 120. In alternative embodiments, the air return duct 324 passes through an interior of fresh food compartment 122. An inlet of the air return duct 324 may be provided at a top of the air return duct 324. The inlet of the air return duct 324 may be in fluid communication with the ice storage compartment 300. An outlet of the air return duct 324 may be provided at a bottom of the air return duct 324. The outlet of the air return duct 324 may be in fluid communication with the freezer compartment 124. Thus, chilled air may be circulated from the freezer compartment 124 through the air supply duct 322, into the ice storage compartment 300, through the air return duct 324, and back into the freezer compartment 124 by operation of the fan 320. Although the cooling system described above relies on forced convection through ducts that fluidly couple the ice storage compartment 300 and the freezer compartment, it should be appreciated that any other suitable system for cooling ice storage compartment may be used according to alternative embodiments.

Refrigerator appliance 100 may further include systems for detecting a level of ice, e.g., to help determine when ice production may stop, when ice harvest may occur, etc. For example, the refrigerator appliance 100 according to an exemplary embodiment may further include a sensor 330 configured to sense a level of ice stored in the ice storage compartment 300. The sensor 330 may be any suitable sensor able to detect an amount of ice stored in the ice storage compartment 300, such as an optical sensor, an infrared sensor, an acoustic sensor, etc. For example, the sensor 330 may be an infrared sensor. The sensor 330 may be provided in the ice storage compartment 300. In one example, the sensor is provided in the ice storage bucket 310 within the ice storage compartment 300. The sensor 330 may be operably connected to the controller 190. The sensor 330 may send signals relating to a level of ice within the ice storage compartment 300 to the controller 190. Although the ice level detection system is described herein as a sensor, it should be appreciated that any other suitable means for detecting ice level may be used according to alternative embodiments, such as a mechanical ice level arm.

Figure 5:
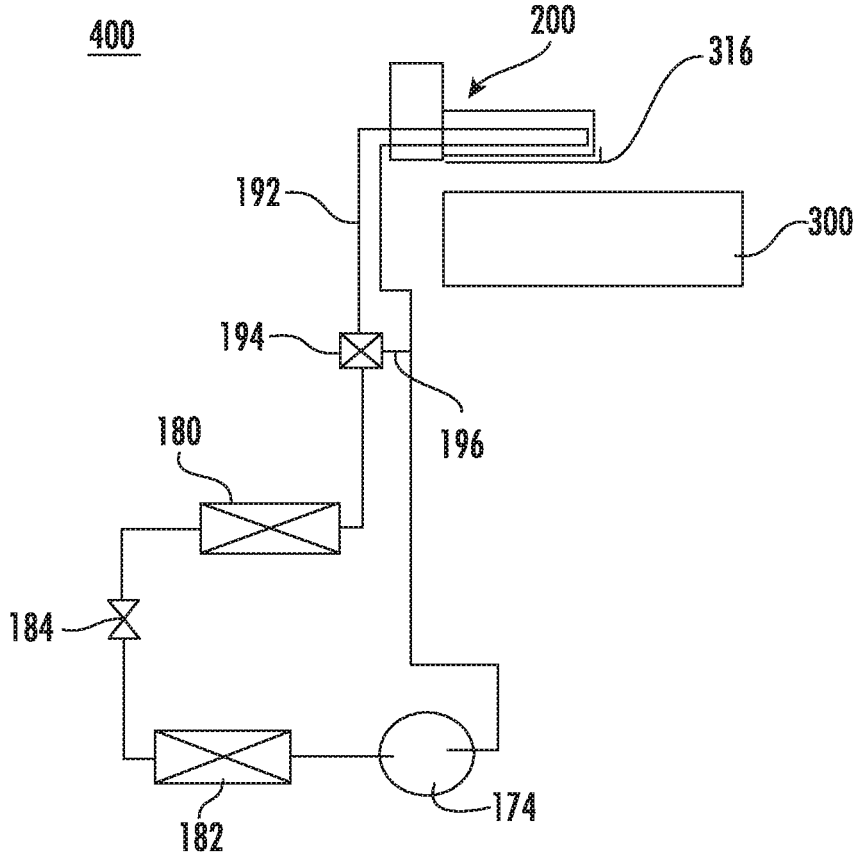
FIG. 5 provides a schematic view of a sealed refrigerant system according to the exemplary refrigerator appliance of FIG. 1.

FIG. 5 illustrates a schematic view of a sealed refrigerant system 400 that is generally configured for executing a vapor compression cycle. According to FIG. 5, a sealed refrigerant system, or sealed system 400 may circulate a refrigerant via a refrigerating conduit 192. The sealed system may include a compressor 174, a condenser 182, an expansion device 184, and an evaporator 180. Each of the compressor 174, condenser 182, expansion device 184, and evaporator 180 may be fluidly connected to one another by the refrigerating conduit or first refrigerating conduit 192. The evaporator 180 may be provided in the freezer compartment 124 and may be configured to cool air within the freezer compartment 124.

Within sealed system 400, gaseous refrigerant flows into compressor 174, which operates to increase the pressure of the refrigerant. This compression of the refrigerant raises its temperature, which is lowered by passing the gaseous refrigerant through condenser 182. Within condenser 182, heat exchange with ambient air takes place so as to cool the refrigerant and cause the refrigerant to condense to a liquid state.

Expansion device 184 (e.g., a mechanical valve, capillary tube, electronic expansion valve, or other restriction device) receives liquid refrigerant from condenser 182. From expansion device 184, the liquid refrigerant enters evaporator 180. Upon exiting expansion device 184 and entering evaporator 180, the liquid refrigerant drops in pressure and vaporizes. Due to the pressure drop and phase change of the refrigerant, evaporator 180 is cool relative to freezer compartment 124. As such, cooled water and ice or air is produced and refrigerates icemaker 200 or freezer compartment 124. Thus, evaporator 180 is a heat exchanger which transfers heat from water or air in thermal communication with evaporator 180 to refrigerant flowing through evaporator 180.

The sealed refrigerant system 400 may include a three-way valve 194 operably coupled to the refrigerant conduit 192 between the evaporator 180 and the icemaker 200. The three-way valve 194 may be selectively opened to allow refrigerant to circulate through the icemaker 200. The controller 190 may control an opening and closing of the three-way valve 194 to allow the refrigerant to circulate through the icemaker 200. The three-way valve 194 may be any suitable valve capable of selectively opening and closing a bypass passageway 196. For example, the three-way valve 194 may have one inlet and two outlets, and the controller 190 may control one outlet to be open at a time. As such, refrigerant may either circulate through the refrigerant conduit 192 or through the bypass passageway 196.

According to one example, the controller 190 may control the three-way valve 194 to close the bypass passageway 196 to allow refrigerant to circulate through the icemaker 200. In this manner, icemaker 200 is supplied with refrigerant to form ice cubes. According to another example, the controller 190 may control the three-way valve 194 to open the bypass passageway 196 to restrict refrigerant from circulating through the icemaker 200. In this manner, no refrigerant is supplied to the icemaker 200. Consequently, because the icemaker 200 is provided in the fresh food compartment 122, which is maintained at a temperature above freezing, frost formed on an outside of the icemaker 200 may melt off, preventing malfunction or failure of the icemaker 200.

The refrigerator appliance 100 according to an exemplary embodiment may further include a drain pan or drain conduit 316. The drain conduit 316 may be provided beneath the icemaker 200 and may collect condensate or melt water from the icemaker 200. Melt water may be formed as frost on the icemaker 200 melts when the icemaker 200 is in an inactive state (e.g., no refrigerant is being cycled to the icemaker 200). In other words, when the three-way valve 194 is closed (i.e., refrigerant is circulated through the bypass passageway 196), frost on the icemaker 200 melts due to exposure to air that is above freezing within the fresh food compartment 122. The drain conduit 316 may be a pan located beneath the icemaker 200. The drain conduit 316 may then guide melt water to an outside of the refrigerator appliance 100 or to any other suitable collection container or reservoir.

Figure 6:
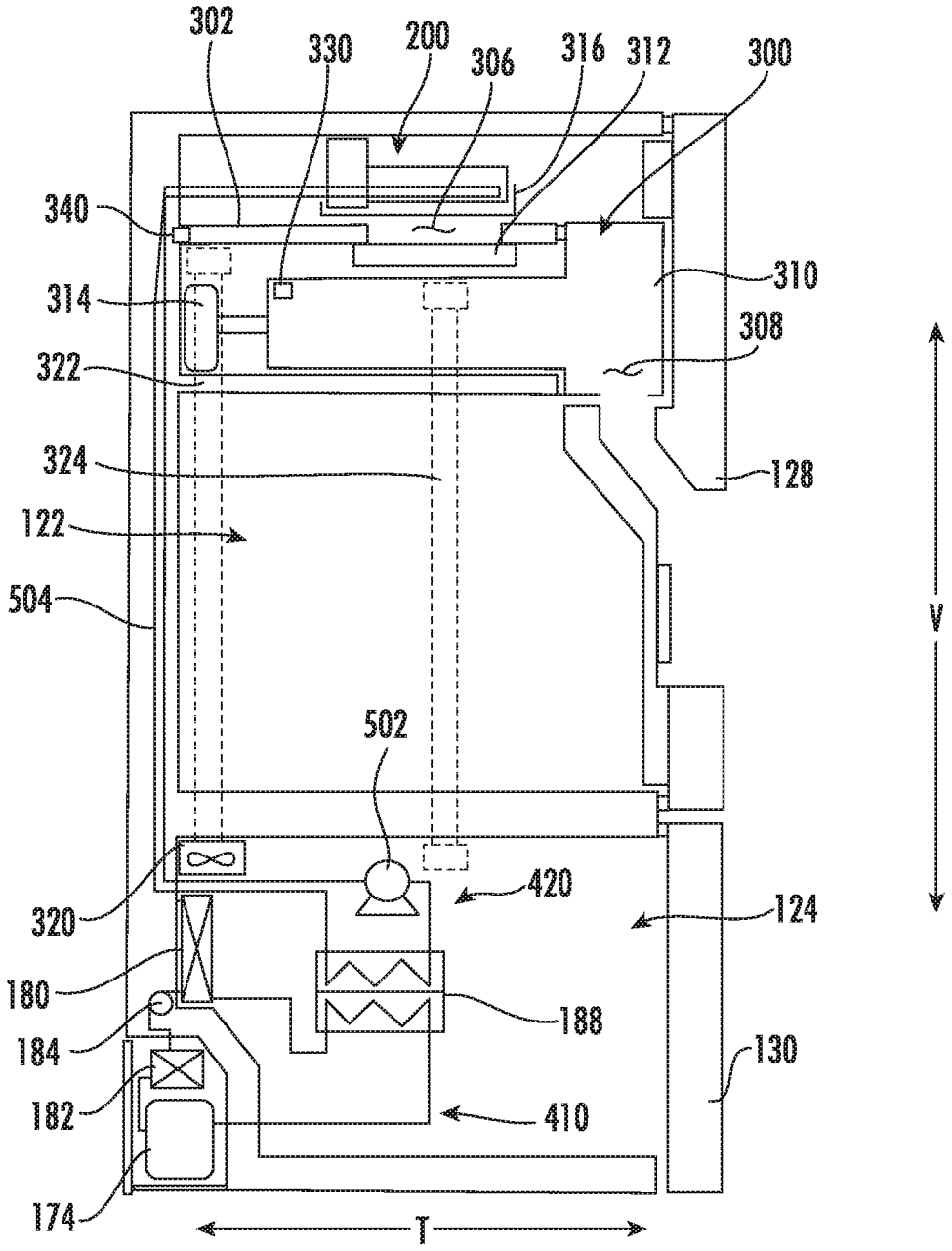
FIG. 6 provides a side cross-sectional view of another exemplary embodiment of the refrigerator appliance.

FIG. 6 illustrates another exemplary embodiment of the refrigerator appliance 100. Due to the similarities between embodiments described herein, like reference numerals may be used to refer to the same or similar features. According to this embodiment, the sealed system 400 includes a first sealed system 410 and a second sealed system 420. The first sealed system 410 may include the compressor 174, the condenser 182, the expansion device 184, and the evaporator 180, all in fluid communication with each other through the refrigerant conduit 192. The operation of these elements is described above; thus, a repeat detailed description is omitted. The refrigerant conduit 192 may also pass through a heat exchanger 188. The heat exchanger 188 may be a heat exchanger configured to exchange heat between two sealed systems. For example, the heat exchanger 188 is a liquid-to-liquid heat exchanger.

The second sealed system 420 may include a pump 502 and a second refrigerant conduit 504. The pump 502 may be a fluid pump configured to circulate a refrigerant through the second refrigerant conduit 504. The second refrigerant conduit 504 may pass through the heat exchanger 188. The second refrigerant conduit 504 may pass through the icemaker 200. The second refrigerant conduit 504 may exchange heat with the first refrigerant conduit 192 within the heat exchanger 188. The cooled refrigerant may then be circulated through the icemaker 200 by the pump 502. The refrigerant circulated through second refrigerant conduit 192 may be any suitable refrigerant capable of retaining and distributing heat. For example, the refrigerant circulated through the second refrigerant conduit 192 may be a water/glycol brine solution. Additionally, or alternatively, a propylene glycol, ethylene glycol, or antifreeze solution may be used.

Figure 7:
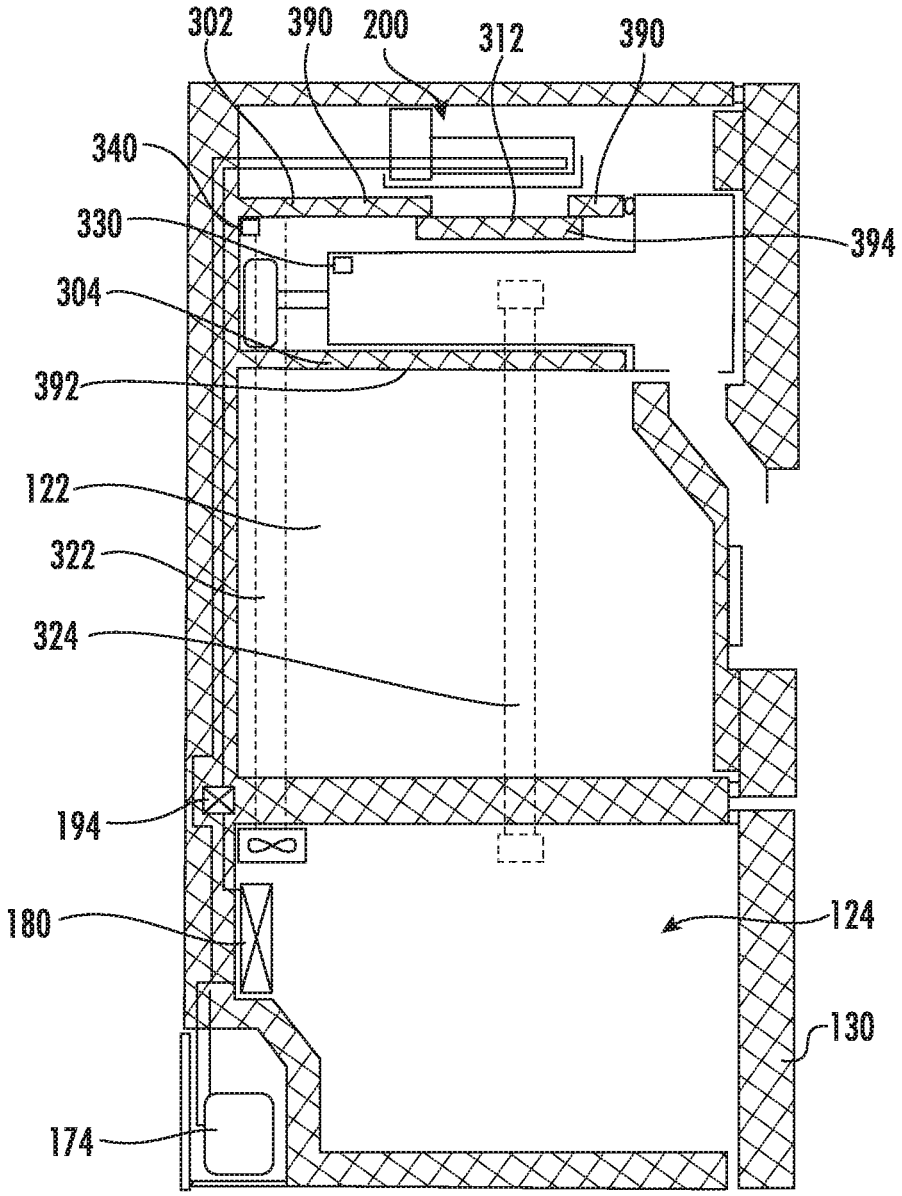
FIG. 7 provides a side cross-sectional view of an exemplary refrigerator appliance with an insulated door in a closed position.

FIG. 7 illustrates the various insulated walls, mullions, partitions, or other insulated structures within cabinet 102 of refrigerator appliance 100. For clarity, the insulated structures are illustrated here using cross hatching. Specifically, as illustrated, the ice storage compartment 300 may be located in the fresh food compartment 122 of the exemplary refrigerator appliance 100. The ice storage compartment 300 may be insulated from the fresh food compartment 122. For instance, upper wall 302 may have a first insulation 390. First insulation 390 may be an insulated coating provided over the upper wall 302. In one example, the upper wall 302 may be coated in a foam insulation spray. In another example, the upper wall 302 may define an inner volume filled with insulation.

Similarly, the lower wall 304 may have a second insulation 392. Second insulation 392 may be an insulated coating provided over the lower wall 304. In one example, the lower wall 304 may be coated in a foam insulation spray. In another example, the lower wall 304 may define an inner volume filled with insulation. The insulated door 312 may have a third insulation 394. Third insulation 394 may be an insulated coating provided over the insulated door 312. In one example, the insulated door 312 may be coated in a foam insulation spray. In another example, the insulated door 312 may define an inner volume filled with insulation.

Referring to FIGS. 1 through 7, a method of operating an exemplary refrigerator appliance 100 will be described. The sealed system 400 may be operated by driving the compressor 174 to circulate a refrigerant through the icemaker 200. At this time, the three-way valve 194 is in an open position (e.g., the bypass passageway 196 is closed). As the chilled refrigerant is circulated through the icemaker 200, ice cubes may be formed in icemaker 200. Once the controller 190 determines that the ice cubes have been formed and that a harvest cycle is ready to be performed, the controller 190 may activate the drive mechanism 340 to open the insulated door 312. Once the insulated door 312 is in the opened position, the ice cubes may be harvested from the icemaker 200 (e.g., the ice cubes are dropped into the ice storage compartment 300 through the supply opening 306).

While the ice cubes are being harvested from the icemaker 200, the controller 190 may turn off the fan 320. Accordingly, cool air from the freezer compartment 124 may not be supplied to the ice storage compartment 300 during a harvesting of the ice cubes. This prevents an unwanted cooling of the fresh food compartment 122 when the insulated door 312 is in the opened position. Simultaneously, the controller 190 may switch the three-way valve 194 to a closed position (e.g., the bypass passageway 196 is opened). Thus, the refrigerant may not be circulated through the icemaker 200 during a harvesting of the ice cubes. This prevents frost from forming on the icemaker 200 due to sublimation of moisture from the ice cubes and/or cool air within the ice storage compartment 300.

After the ice cubes have been harvested (e.g., moved from the icemaker 200 to the ice storage compartment 300), the controller 190 may activate the drive mechanism to move the insulated door 312 to the closed position (e.g., close the supply opening 306). The controller 190 may then switch the three-way valve 194 to the open position (e.g., close the bypass passageway 196). Accordingly, refrigerant may flow through the icemaker 200 to reinstitute an icemaking operation. Sensor 330 may then sense an amount of ice in the ice storage compartment 300. When the sensor 330 senses that an amount of ice is above a first predetermined amount, the controller 190 may switch the three-way valve to the closed position (e.g., open the bypass passageway 196). The first predetermined amount may signify that the ice storage compartment 300 is substantially full. Thus, refrigerant is not circulated through the icemaker 200. Accordingly, frost accumulated on the icemaker 200 may be melted due to a position of the icemaker 200 in the fresh food compartment 122 and subsequent exposure to an above freezing atmosphere.

According to some embodiments, when the sensor 330 senses that an amount of ice is above the first predetermined amount, the controller 190 may switch the pump 502 to an off position. Thus, refrigerant in the second refrigerant conduit 504 may be prevented from circulating through icemaker 200. Accordingly, frost accumulated on the icemaker 200 may be melted due to a position of the icemaker 200 in the fresh food compartment 122 and subsequent exposure to an above freezing atmosphere.

The sensor 330 may continue to sense an amount of ice in the ice storage compartment 300. When the level of ice sensed by the sensor 330 drops below a second predetermined level lower than the first predetermined level, the controller 190 may switch the three-way valve 194 to the open position (e.g., close the bypass passageway 196). For example, the second predetermined level may signify that the ice storage compartment 300 is approximately half full. In some embodiments, the first predetermined level and the second predetermined level may be the same. Thus, refrigerant may be circulated through the icemaker 200 to again reinstitute the icemaking operation. The method may be repeated as necessary to maintain a usable amount of ice in the ice storage compartment 300.

In an alternate embodiment, when the level of ice sensed by the sensor 330 drops below a second predetermined level lower than the first predetermined level, the controller 190 may switch the pump 502 to an on position. Thus, refrigerant in the second refrigerant conduit 504 may be circulated through the icemaker 200 to again reinstitute the icemaking operation. The method may be repeated as necessary to maintain a usable amount of ice in the ice storage compartment 300.

Figure 8:
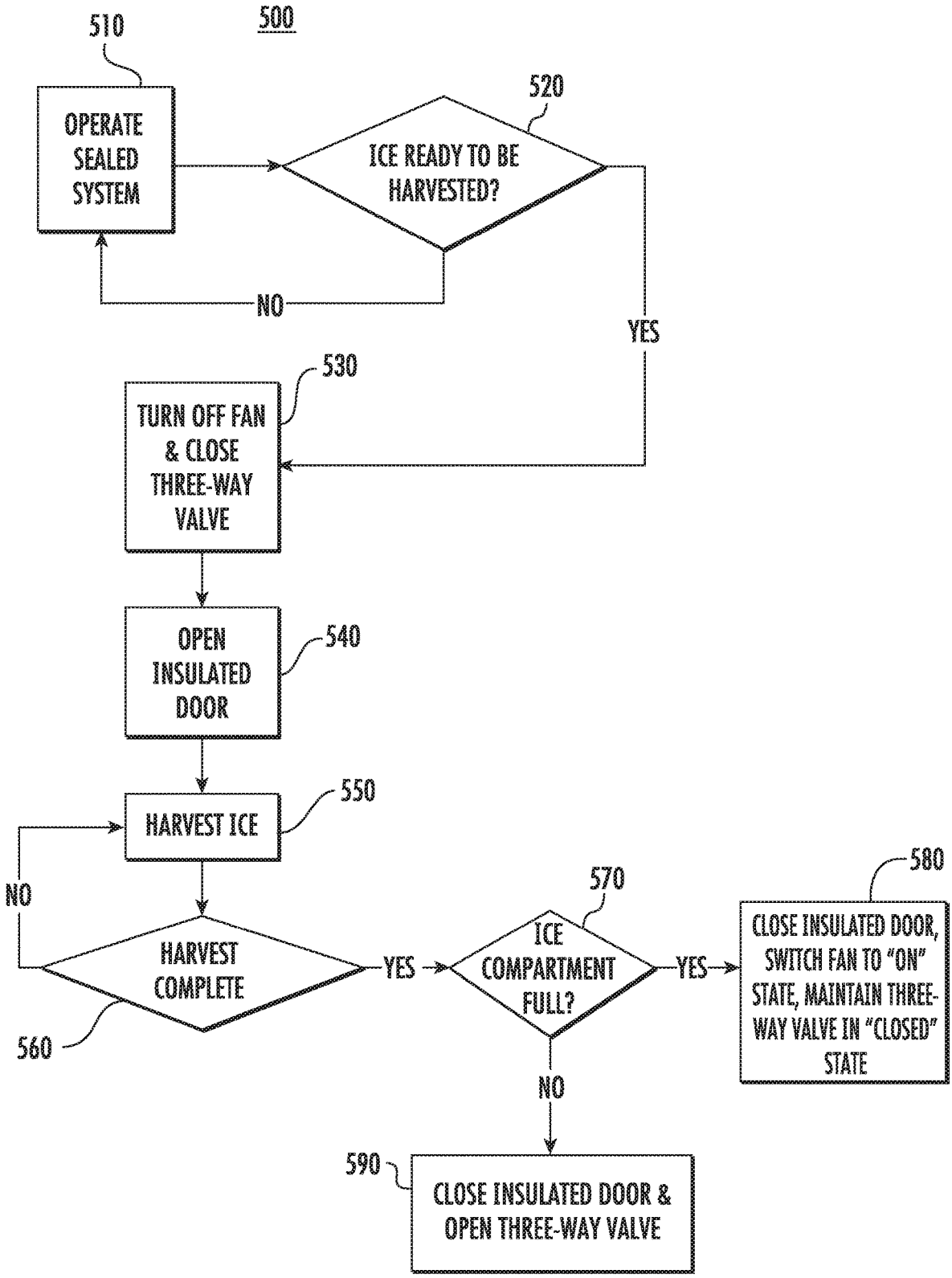
FIG. 8 provides a flow chart illustrating a method of operating the exemplary refrigerator of FIG. 1.

Turning now to FIG. 8, a method 500 of operating a refrigerator appliance according to an embodiment of the present disclosure will be described (e.g., as or as part of a harvesting and/or storing operation). The refrigerator appliance 100 may be one of the exemplary refrigerator appliances described above, and as such, a detailed description will be omitted.

As shown at 510, the method 500 includes operating the sealed refrigerant system 400 to cool the icemaker 200 and form ice. As described above, the operation of the sealed refrigerant system 400 includes operating the compressor 174 to circulate a refrigerant. At this time, three-way valve 194 is in the open position (e.g., refrigerant is circulating through icemaker 200).

At 520, the method 500 includes determining that ice is ready to be harvested from the icemaker 200. The controller 190 may determine that ice cubes have been formed and sufficiently frozen within icemaker 200 such that they may be moved or dropped into the ice storage compartment 300. The controller 190 may use a variety of means to determine that the ice is ready to be harvested, such as a timer or a sensor. Upon detection that ice is ready to be harvested, the method 500 may proceed to 530.

At 530, the method 500 turns off the fan 320 and closes the three-way valve 194 (e.g., refrigerant is not circulating through icemaker 200). The controller 190 may send a signal to stop the fan 320 from circulating air from freezing compartment 124 into ice storage compartment 300. Thus, cool air from freezing compartment 124 is not supplied to ice storage compartment 300. This may prevent unwanted cooling of fresh food compartment 122 and may limit sublimation of moisture from the ice cubes in ice storage compartment 300 to icemaker 300. Likewise, the controller 190 may activate the three-way valve 194 to stop a flow of the refrigerant to the icemaker 200. Thus, icemaker 200 is not cooled while the ice is ejected from the icemaker 200 into the ice storage compartment 300.

At 540, the method 500 opens the insulated door 312. The controller 190 may send a signal to drive mechanism 340 to move the insulated door 312 from a closed position to an open position. As such, an interior of ice storage compartment 300 is exposed to the fresh food compartment 122 such that the ice cubes may be dropped into the ice storage compartment 300. At 550, ice is then harvested from icemaker 200 and dropped into ice storage compartment 300.

At 560, the method 500 includes determining whether the harvesting is complete. The refrigerator appliance 100 may include sensors configured to detect whether the harvesting is complete, such as rotation sensors or infrared sensors on the icemaker 200. Is the harvesting is determined to be complete, the method 500 moves to 570.

At 570, the method 500 includes determining if an amount of ice in the ice storage compartment 300 is above a predetermined amount. The method 500 may refer to sensor 330 described above to determine an amount of ice in the ice storage compartment 300. If the amount is above the predetermined amount, the method 500 proceeds to 580. At 580, the method 500 includes closing the insulated door 312, switching the fan 320 to the on state, and maintaining the three-way valve 194 in the closed state. As such, the icemaker 200 is not supplied with refrigerant and thus may defrost. Further, cool air is supplied to the ice storage compartment 300 to maintain the ice in a frozen state. If the amount is below the predetermined amount, the method 500 proceeds to 590.

At 590, the method 500 includes closing insulated door 312 and opening three-way valve 194. Once insulated door 312 is closed and three-way valve 194 is opened, an icemaking operation may begin again. The method 500 may be repeated as necessary to continually make and harvest ice up to the predetermined amount. Further, sensor 330 may continually determine an amount of ice in ice storage compartment 300 to determine whether or not to open three-way valve 194 to circulate refrigerant to icemaker 200 and perform the icemaking operation.

Additional benefits and advantages of embodiments of the present disclosure may be apparent to one having ordinary skill in the art. For example, the placement of icemaker 200 within the fresh food compartment may eliminate the need for a water fill tube heater to heat a water fill tube that supplies water to mold body 210. Accordingly, energy and electricity use may be reduced, as well as complexity of manufacturing and amount of parts.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a fresh food compartment;

an ice storage compartment positioned within the fresh food compartment and being insulated from the fresh food compartment;

a sealed system comprising a condenser, an expansion device, and an evaporator fluidly coupled through a refrigerant conduit, and a compressor operably coupled to the refrigerant conduit for circulating a flow of refrigerant through the refrigerant conduit;

an icemaker positioned in the fresh food compartment above the ice storage compartment and comprising an ice mold for receiving water, wherein the sealed system is in direct thermal communication with the ice mold for cooling the ice mold to form ice from the water; and an insulated door positioned over an opening in the ice storage compartment, the insulated door being movable between an open position and a closed position to permit the ice to pass into the ice storage compartment from the icemaker, wherein the ice storage compartment is defined at least in part by an upper wall and a lower wall, and wherein the opening is defined in the upper wall.

2. The refrigerator appliance of claim 1, wherein the refrigerator appliance further comprises:

a three-way valve operably coupled to the refrigerant conduit between the evaporator and the icemaker and configured to selectively open to allow refrigerant to circulate through the icemaker; and a controller configured to control the icemaker, the sealed system, and the three-way valve.

3. The refrigerator appliance of claim 1, further comprising:

a freezer compartment; and an air supply duct through which air is supplied from the freezer compartment to the ice storage compartment, and an air return duct through which air is returned from the ice storage compartment to the freezer compartment.

4. The refrigerator appliance of claim 3, further comprising a fan configured to blow air from the freezer compartment through the air supply duct to the ice storage compartment.

5. The refrigerator appliance of claim 4, wherein the fan is a centrifugal fan and is provided in the freezer compartment.

6. The refrigerator appliance of claim 4, further comprising a sensor configured to measure an amount of ice stored in the ice storage compartment, wherein the controller is configured to close the three-way valve to allow the refrigerant to bypass the icemaker when the amount of ice measured in the ice storage compartment is above a predetermined amount.

7. The refrigerator appliance of claim 6, wherein when the icemaker has completed an ice making operation, the controller is configured to:

activate the three-way valve to allow the refrigerant to bypass the icemaker;

stop the fan;

open the insulated door; and control the icemaker to drop the ice into the ice storage compartment.

8. The refrigerator appliance of claim 1, wherein the lower wall defines a dispensing outlet, the refrigerator appliance further comprising:

a dispensing mechanism for selectively opening and closing the dispensing outlet to dispense the ice in a dispenser recess;

a heater for selectively heating the ice mold to melt frost formed on the ice mold;

a drain conduit fluidly coupled to the icemaker for collecting condensate or melt water from the melted frost; and a drive mechanism operably coupled to the insulated door and configured for selectively moving the insulated door between the opened position and the closed position.

9. The refrigerator appliance of claim 1, wherein the refrigerant conduit passes through the ice mold to directly cool the icemaker.

10. A refrigerator appliance, comprising:

a fresh food compartment;

a freezer compartment adjacent to the fresh food compartment;

a first sealed refrigerant system to circulate a first refrigerant and including a compressor, a condenser, an expansion device, an evaporator, and a first refrigerant conduit;

a second sealed refrigerant system to circulate a second refrigerant and provided adjacent to the first sealed refrigerant system, the second sealed refrigerant system including a coolant pump and a second refrigerant conduit;

a liquid-to-liquid heat exchanger through which the first refrigerant conduit and the second refrigerant conduit pass;

an icemaker provided in the fresh food compartment, the second refrigerant conduit being configured to pass through the icemaker to directly cool the icemaker to make ice;

an ice storage compartment provided below the icemaker and insulated from the fresh food compartment;

an insulated door positioned over an opening in the ice storage compartment, the insulated door being movable between an open position and a closed position to permit the ice to pass into the ice storage compartment from the icemaker, the insulated door being movable linearly along a horizontal direction; and a controller configured to control the icemaker, the first sealed refrigerant system, the second sealed refrigerant system, and the insulated door.

11. The refrigerator appliance of claim 10, wherein the first refrigerant conduit is directly adjacent to the second refrigerant conduit within the liquid-to-liquid heat exchanger such that heat is transferred between the first refrigerant system and the second refrigerant system.

12. The refrigerator appliance of claim 11, further comprising a sensor configured to measure an amount of ice stored in the ice storage compartment, wherein the controller is configured to activate the coolant pump when the amount of ice in the ice storage compartment is below a predetermined amount and deactivate the coolant pump when the amount of ice in the ice storage compartment is at or above the predetermined amount.

13. The refrigerator appliance of claim 10, further comprising an air supply duct through which air is supplied from the freezer compartment to the ice storage compartment, and an air return duct through which air is returned from the ice storage compartment to the freezer compartment.

14. The refrigerator appliance of claim 13, wherein the ice storage compartment is provided within the fresh food compartment.

15. The refrigerator appliance of claim 14, further comprising a fan configured to blow air from the freezer compartment through the air supply duct to the ice storage compartment.

16. The refrigerator appliance of claim 15, wherein the fan is a centrifugal fan and is provided in the freezer compartment.

17. A method of operating a refrigerator appliance including a fresh food compartment, an ice storage compartment positioned within the fresh food compartment and including an insulated door, the ice storage compartment being defined at least in part by an upper wall and a lower wall and having an opening defined in the upper wall, an icemaker positioned above the ice storage compartment, and a sealed refrigerant system configured for selectively cooling the icemaker, the method comprising:

operating the sealed refrigerant system to cool the icemaker and form ice;

determining that ice is ready to be harvested from the icemaker;

opening the insulated door; and ejecting the ice from the icemaker such that the ice passes from the icemaker to the ice storage compartment.

18. The method of claim 17, further comprising:

a freezing compartment adjacent to the fresh food compartment;

a fan configured to circulate air from the freezing compartment to the ice storage compartment; and a three-way valve configured to selectively allow refrigerant in the sealed refrigerant system to bypass the icemaker, wherein when the ice is ready to be harvested from the icemaker, the method further comprises:

turning off the fan; and closing the three-way valve to stop a flow of the refrigerant to the icemaker.

19. The method of claim 18, wherein after the ice is harvested from the icemaker, the method further comprises:

closing the insulated door;

opening the three-way valve to supply the refrigerant to the icemaker;

sensing an amount of ice in the ice storage compartment is above a first predetermined amount; and reclosing the three-way valve to stop the flow of the refrigerant to the icemaker until the amount of ice sensed in the ice storage compartment drops below a second predetermined amount less than the first predetermined amount.

* * * * *